US010811750B2

(12) United States Patent
Campbell

(10) Patent No.: US 10,811,750 B2
(45) Date of Patent: Oct. 20, 2020

(54) CIRCULATOR SYSTEM

(71) Applicant: Qorvo US, Inc., Greensboro, NC (US)

(72) Inventor: Charles Forrest Campbell, Dallas, TX (US)

(73) Assignee: Qorvo US, Inc., Greensboro, NC (US)

( * ) Notice: Subject to any disclaimer, the term of this patent is extended or adjusted under 35 U.S.C. 154(b) by 92 days.

(21) Appl. No.: 16/251,323

(22) Filed: Jan. 18, 2019

(65) Prior Publication Data

US 2020/0083583 A1 Mar. 12, 2020

Related U.S. Application Data

(60) Provisional application No. 62/729,652, filed on Sep. 11, 2018, provisional application No. 62/730,202, filed on Sep. 12, 2018.

(51) Int. Cl.

| | |
|---|---|
| ***H01P 1/38*** | (2006.01) |
| ***H01P 1/383*** | (2006.01) |
| ***H01Q 15/00*** | (2006.01) |

(52) U.S. Cl.

CPC ..... *H01P 1/383* (2013.01); *H01P 1/38* (2013.01); *H01Q 15/002* (2013.01)

(58) Field of Classification Search

CPC ..... H01P 1/32; H01P 1/36; H01P 1/38; H01P 1/383; H01P 1/387; H01P 1/39; H01Q 15/00; H01Q 15/002

USPC ..... 333/1.1, 24.2

See application file for complete search history.

(56) References Cited

U.S. PATENT DOCUMENTS

| | | | | |
|---|---|---|---|---|
| 4,430,619 | A * | 2/1984 | Epsom | H03F 3/189 327/100 |
| 8,130,054 | B1 * | 3/2012 | Martin | H01P 1/36 333/1.1 |
| 10,200,026 | B1 * | 2/2019 | Shapiro | H03K 17/161 |
| 2008/0272959 | A1 * | 11/2008 | Meharry | G01S 7/034 342/174 |
| 2016/0105272 | A1 * | 4/2016 | Griffiths | H04B 1/00 370/278 |

OTHER PUBLICATIONS

Boaventura, Alirio, et. al., "Perfect Isolation: Dealing with Self-Jamming in Passive RFID Systems," IEEE Microwave Magazine, vol. 17, Issue 11, Nov. 2016, pp. 20-39.

(Continued)

*Primary Examiner* — Stephen E. Jones

(74) *Attorney, Agent, or Firm* — Withrow & Terranova, P.L.L.C.

(57) ABSTRACT

An apparatus is disclosed having a circulator having a transmit port, a receive port, and a tuner port with tuner circuitry coupled between the tuner port and an antenna port. At least one analog control branch is coupled between the receive port and at least one control input of the tuner circuitry to generate at least one control signal from a transmit leakage signal leaking into the receive port. The tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −30 dB between the transmit port and the receive port.

20 Claims, 10 Drawing Sheets

(56) References Cited

OTHER PUBLICATIONS

Chen, Po-Wen, et. al., "A High Isolation Quasi-Circulator with Self-Adjusting Technique", Asia-Pacific Microwave Conference, Nov. 2014, IEEE, pp. 268-270.
Debaillie, Bjorn, et. al., "Analog/RF Solutions Enabling Compact Full-Duplex Radios", IEEE Journal on Selected Areas in Communications, vol. 32, Issue 9, Jun. 2014, 13 pages.
Huusari, Timo, et. al., "Wideband Self-Adaptive RF Cancellation Circuit for Full-Duplex Radio: Operating Principle and Measurements", Vehicular Technology Conference, May 2015, IEEE, 7 pages.
Kolodziej, K.E., et. al. "Single Antenna In-Band Full-Duplex Isolation-Improvement Techniques", International Symposium on Antennas and Propagation, Oct. 2016, IEEE, pp. 1661-1662.
Pochiraju, T., et. al., "Reflection/transmission tuner analysis and applications", IET Microwaves, Antennas & Propagation, vol. 4, Issue 9, 2010, IET, pp. 1387-1396.

* cited by examiner

CIRCULATOR SYSTEM

RELATED APPLICATIONS

This application claims the benefit of provisional patent application Ser. No. 62/729,652, filed Sep. 11, 2018, and of provisional patent application Ser. No. 62/730,202, filed Sep. 12, 2018, the disclosures of which are hereby incorporated herein by reference in their entireties.

GOVERNMENT SUPPORT

This disclosure was made with government funds under contract number HR0011-17-C-0017 awarded by the Defense Advanced Research Projects Agency Signal Processing at RF (DARPA SPAR) program through Rockwell Collins, Inc., Cedar Rapids, Iowa. The U.S. Government may have rights in this disclosure.

FIELD OF THE DISCLOSURE

The present disclosure relates to radio frequency (RF) circulators and in particular to three-port circulators employed by RF front ends to route RF signals to and from antennas.

BACKGROUND

In radio frequency (RF) transceiver systems, a magnetic circulator is frequently used to enable simultaneous signal transmission and reception over a single antenna. The magnetic circulator routes the signals between a transmit ($T_X$) port, an antenna port, and a receive ($R_X$) port while providing isolation between the $T_X$ port and the $R_X$ port. The magnetic circulator includes a permanent magnet that causes signals to pass through its material along one direction, such that signals travel from the $T_X$ port to the antenna port and from the antenna port to the $R_X$ port. Practical circulators undesirably allow some transmitter power to leak from the $T_X$ port to the $R_X$ port. What is needed is a circulator system that reduces the undesired leakage of transmitter power into the $R_X$ port.

SUMMARY

An apparatus is disclosed having a circulator having a transmit port, a receive port, and a tuner port with tuner circuitry coupled between the tuner port and an antenna port. At least one analog control branch is coupled between the receive port and at least one control input of the tuner circuitry to generate at least one control signal from a transmit leakage signal leaking into the receive port. The tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −30 dB between the transmit port and the receive port.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure and, together with the description, serve to explain the principles of the disclosure.

DETAILED DESCRIPTION

Figure 1:
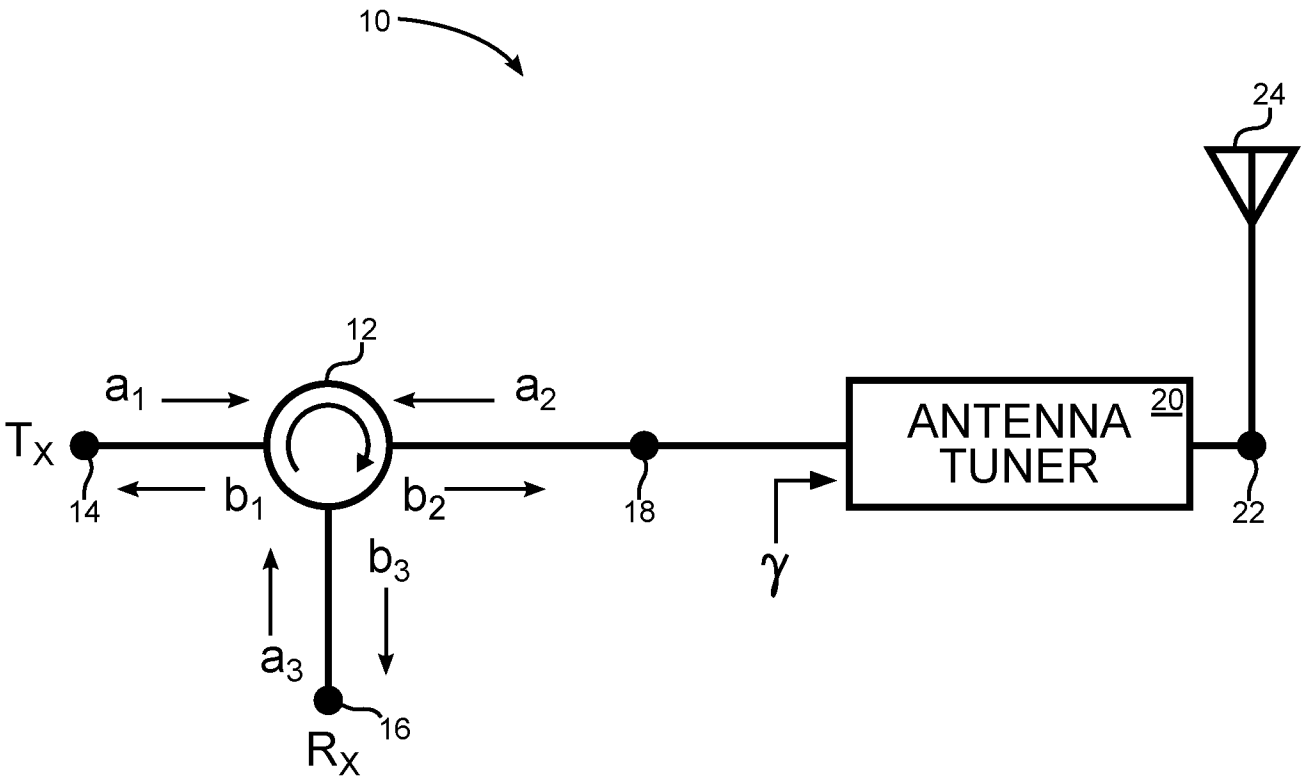
FIG. 1 (RELATED ART)
FIG. 1 is a diagram of a related-art circulator system having a circulator with tuner circuitry coupled between the circulator and an antenna.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein. For the purpose of this disclosure a natural number is defined as a counting number that does not include infinity.

FIG. 1 is a diagram of a related-art circulator system 10 having a circulator 12 with a transmit ($T_X$) port 14, a receive ($R_X$) port 16, and a tuner port 18. An antenna tuner 20 is coupled between the tuner port 18 and an antenna port 22 to which an antenna 24 is coupled. A three-port circulator such as circulator 12 is commonly used at the front end of transmit and receive systems to properly route signals to and from an antenna such as the antenna 24. Ideally, the circulator 12 directs 100% of the transmit power passing through the $T_X$ port 14 to the antenna 24. However, practical circulators do not have perfect isolation, and some portion of the transmit power passing through the $T_X$ port 14 leaks into the $R_X$ port 16. For simultaneous transmit and receive full duplex systems, this transmit power leakage at the $R_X$ port 16 can overwhelm a desired received signal, making the desired received signal impossible to detect. Additionally, real antennas are not perfectly matched and a portion of the transmit power reflects off of the antenna 24 and back into the circulator 12. This reflected portion of transmit power is directed by the circulator 12 to the $R_X$ port 16, potentially degrading the overall isolation of the circulator system 10.

In attempts to mitigate the problems set forth above, existing methods for improving isolation between the $T_X$ port 14 and the $R_X$ port 16 generally sample some transmit power from the $T_X$ port 14 by coupling a signal representing the transmit power, adjusting the amplitude and phase of the signal, and injecting the signal into the $R_X$ port 16 to cancel leaks of transmit power that undesirably pass into the $R_X$ port 16. Thus, existing methods require very precise phase and amplitude adjustments, thereby reducing the effectiveness of digitally controlled components that do not have enough bits of resolution to provide a desired level of transmit power leakage cancellation. Moreover, there can be significant electrical length between $T_X$ port 14, $R_X$ port 16, and antenna port 22, which presents challenges to achieving a wide bandwidth response. Further still, a feedback cancellation loop between the $T_X$ port 14 and $R_X$ port 16 may not be able to compensate for unmatched antenna impedance. However, given the issue of non-ideal and potentially varying antenna impedance, the antenna tuner 20 is generally necessary and is adjusted to transform the impedance of the antenna 24 to a complex reflection coefficient $\gamma$. The antenna tuner 20 is assumed to be lossless for the following mathematical modeling.

A symmetric three-port circulator such as the circulator 12 has an s-parameter matrix of the form shown below where $\alpha$, $\beta$ and $\Gamma$ are complex loss, isolation, and reflection coefficients, respectively, that characterize the circulator 12. As depicted in FIG. 1, signals $a_1$, $a_2$, $a_3$, $b_1$, $b_2$, and $b_3$ depicted with direction arrows are variables of the s-parameter matrix given below.

$$\begin{bmatrix} b_1 \\ b_2 \\ b_3 \end{bmatrix} = \begin{bmatrix} \Gamma & \beta & \alpha \\ \alpha & \Gamma & \beta \\ \beta & \alpha & \Gamma \end{bmatrix} \begin{bmatrix} a_1 \\ a_2 \\ a_3 \end{bmatrix}$$

Expanding this matrix results in the following set of three simultaneous equations:

$$b_1=\Gamma a_1+\beta a_2+\alpha a_3 \quad \text{EQ. 1a}$$

$$b_2=\alpha a_1+\Gamma a_2+\beta a_3 \quad \text{EQ. 1b}$$

$$b_3=\beta a_1+\alpha a_2+\Gamma a_3 \quad \text{EQ. 1c}$$

Referring to FIG. 1, assume that the $R_X$ port 16 is perfectly terminated such that $a_3=0$ when the network is excited at the $T_X$ port 14. This simplification reduces the set of three simultaneous equations to two simultaneous equations.

$$b_2=\alpha a_1+\Gamma a_2 \quad \text{EQ. 2a}$$

$$b_3=\beta a_1+\alpha a_2 \quad \text{EQ. 2b}$$

As shown in FIG. 1, the lossless antenna tuner 20 connected to antenna port 22 labeled ANT presents a non-zero complex reflection coefficient $\gamma$ such that $a_2=\gamma b_2$. The antenna 24 need not be matched as long the antenna tuner 20 can transform the impedance of the antenna 24 to the reflection coefficient $\gamma$. Substituting $\gamma b_2$ for $a_2$ into EQ. 2a and EQ. 2b, and then simultaneously solving EQ. 2a and EQ. 2b, yields $b_2$ and $b_3$ as functions of the input $T_X$ signal $a_1$.

$$b_2 = \left(\frac{\alpha}{1-\gamma\Gamma}\right)a_1 \quad \text{EQ. 3a}$$

$$b_3 = \left(\beta + \frac{\gamma\alpha^2}{1-\gamma\Gamma}\right)a_1 \quad \text{EQ. 3b}$$

The complex isolation coefficient of the circulator 12 with the antenna tuner 20 is found by solving Eq. (3b).

$$Tx \text{ to } Rx\ Iso = \frac{b_3}{a_1} = \beta + \frac{\gamma\alpha^2}{1-\gamma\Gamma} \quad \text{EQ. 4}$$

The cancellation method of this disclosure is to set the tuner input reflection coefficient $\gamma$ to a value that results in perfect isolation, that is, EQ. 4 being equal to zero. Setting EQ. 4 equal to zero and solving for $\gamma$ produces the reflection coefficient required from the tuner to achieve perfect cancellation of the $T_X$ leakage signal. The result is shown below in EQ. 5.

$$\gamma = \frac{\beta}{\beta\Gamma - \alpha^2} \quad \text{EQ. 5}$$

Figure 2:
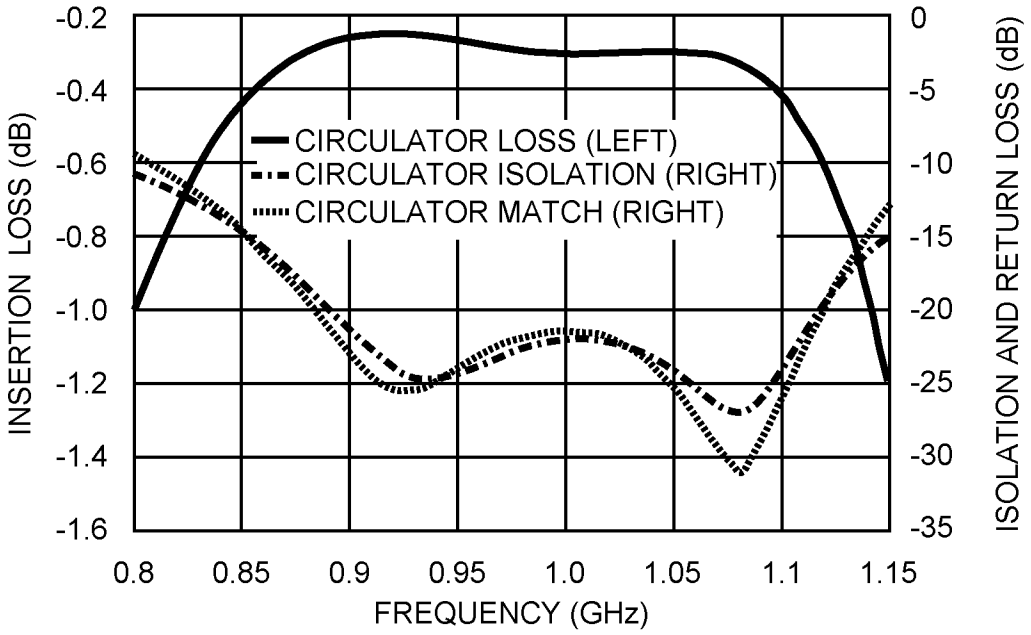
FIG. 2 is a graph of circulator insertion loss, isolation, and impedance match return loss extracted from measured data for a commercially available circulator.

To test the cancellation method of this disclosure, loss, isolation, and match data for a surface mount circulator were measured and are plotted in FIG. 2. The tuner reflection coefficient for perfect cancellation as calculated with Eq. (5) from the complex circulator data is shown in FIG. 3.

Figure 3:
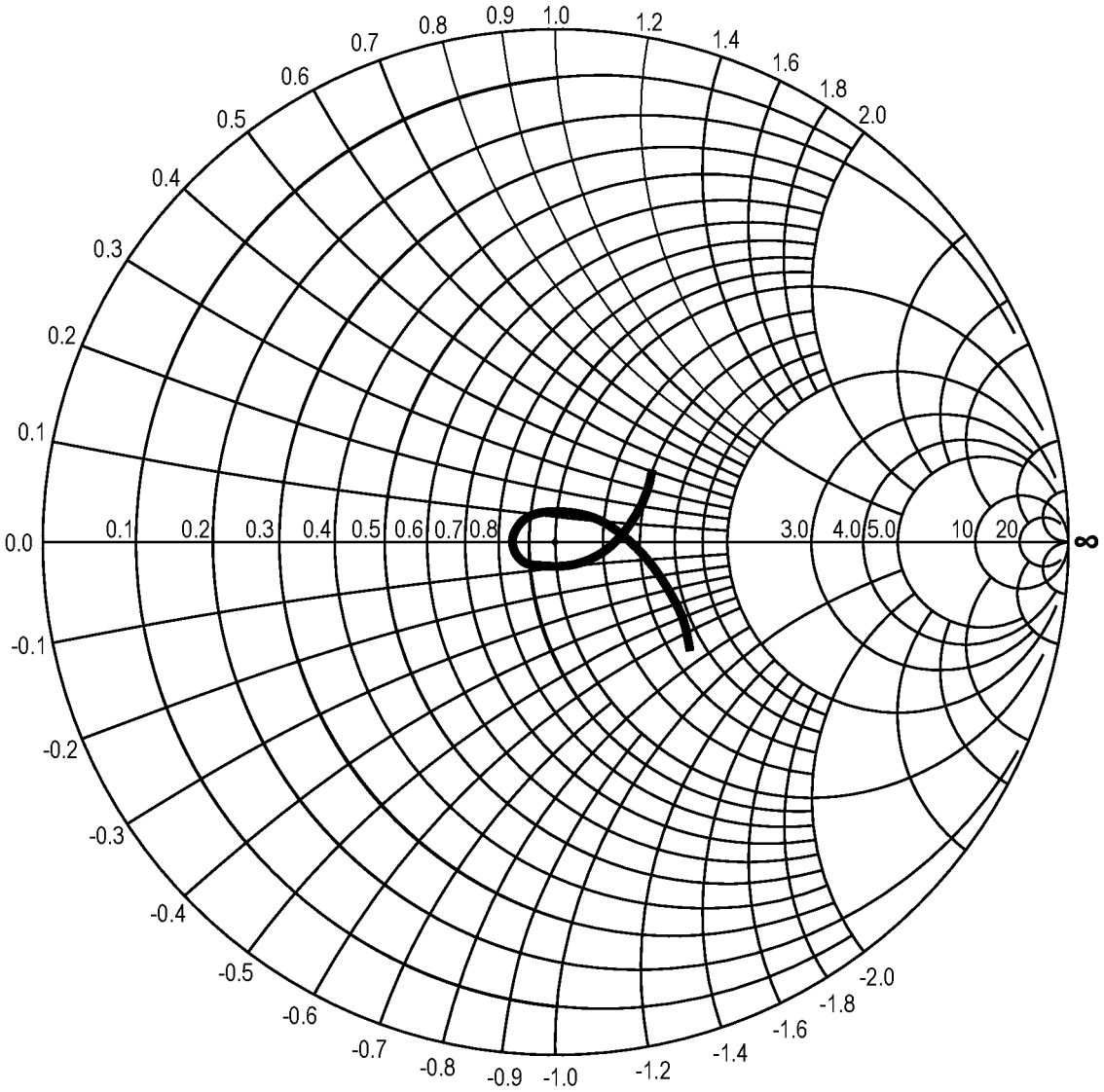
FIG. 3 is a Smith chart depicting a tuner reflection coefficient for perfect receive ($R_X$) port cancellation.
Figure 4:
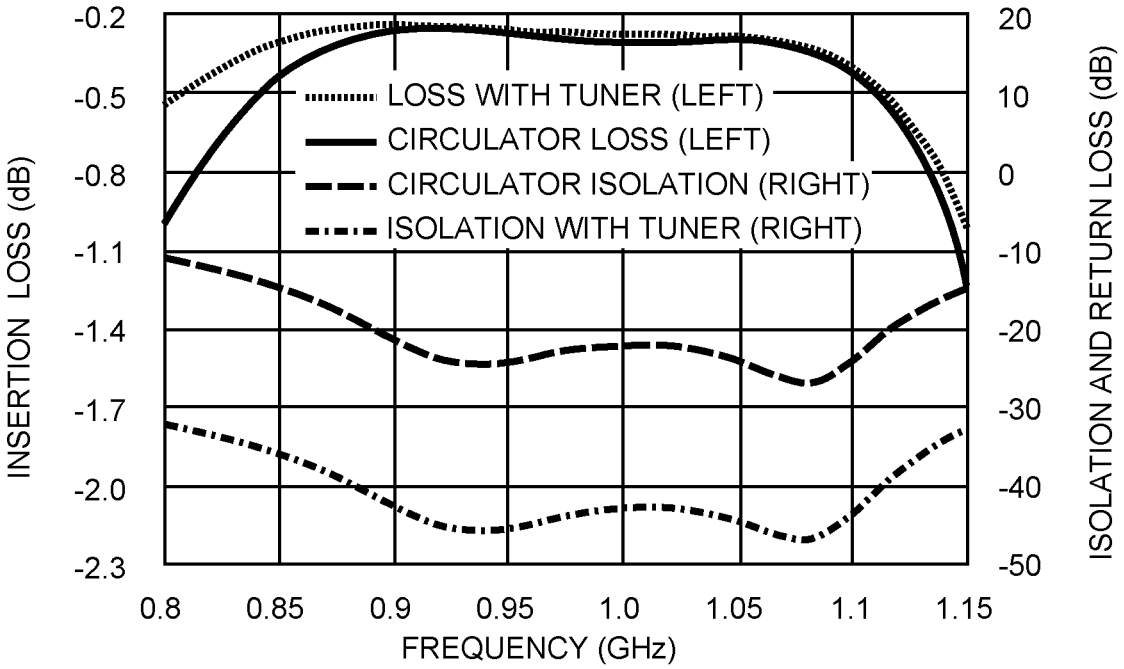
FIG. 4 is a graph comparing circulator insertion loss and circulator isolation extracted from measured data to simulated results of circulator insertion loss and circulator isolation when tuned for transmit ($T_X$) port to $R_X$ port leakage cancellation in accordance with the present disclosure.
Figure 5:
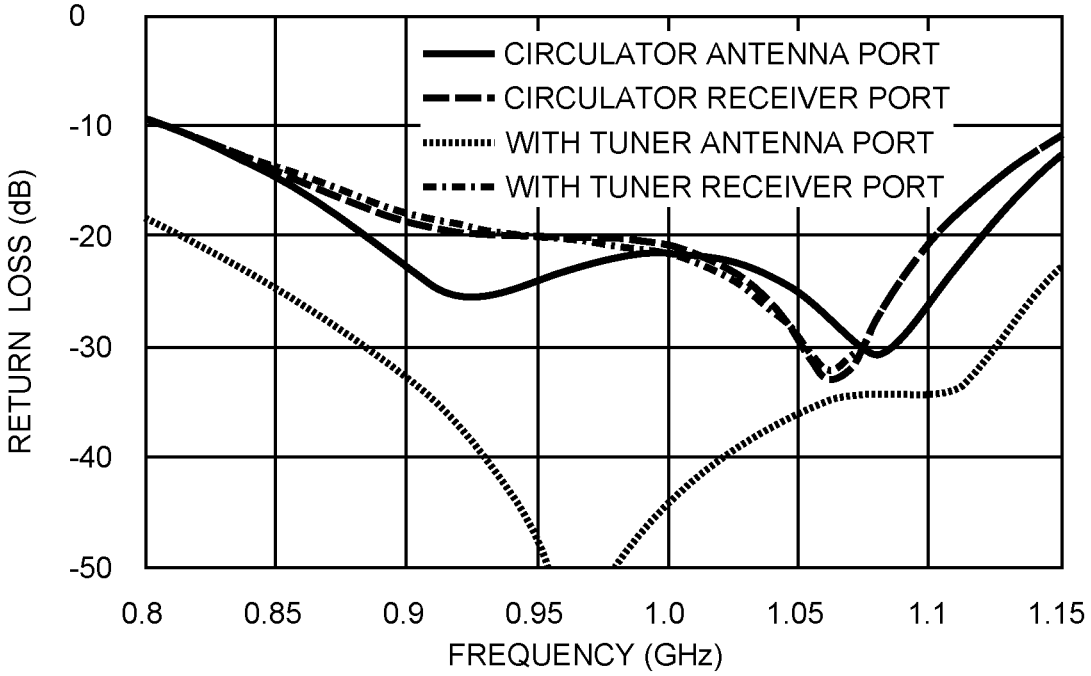
FIG. 5 is a graph comparing return loss for a circulator antenna port and $R_X$ port extracted from measured data to simulated results of return loss for the circulator antenna port and the $R_X$ port when tuned for $T_X$ port to $R_X$ port leakage cancellation in accordance with the present disclosure.

Using the tuner gamma values from FIG. 3 and a lossless tuner, the simulated performance of the circulator system 10 along with the stand-alone circulator data is plotted in FIG. 4 and FIG. 5. As expected, the isolation is significantly improved over that of the circulator 12 alone. Note that the insertion loss is also improved. Although not intuitively obvious, insertion loss improvement is predicted by a more detailed analysis of the general case. The cancellation of leakage from the $T_X$ port 14 is not perfect due to asymmetry in the measured three-port s-parameter data for a manufactured circulator. This can be seen in FIG. 5 where return losses for the $R_X$ port 16 and the antenna port 22 of the circulator 12 are slightly different. The impact of the antenna tuner 20 on the return losses the $R_X$ port 16 and the antenna port 22 is characterized in FIG. 5. The return loss for the antenna port 22 is greatly improved by cancellation tuning, while the $R_X$ return loss is largely unchanged.

Figure 6:
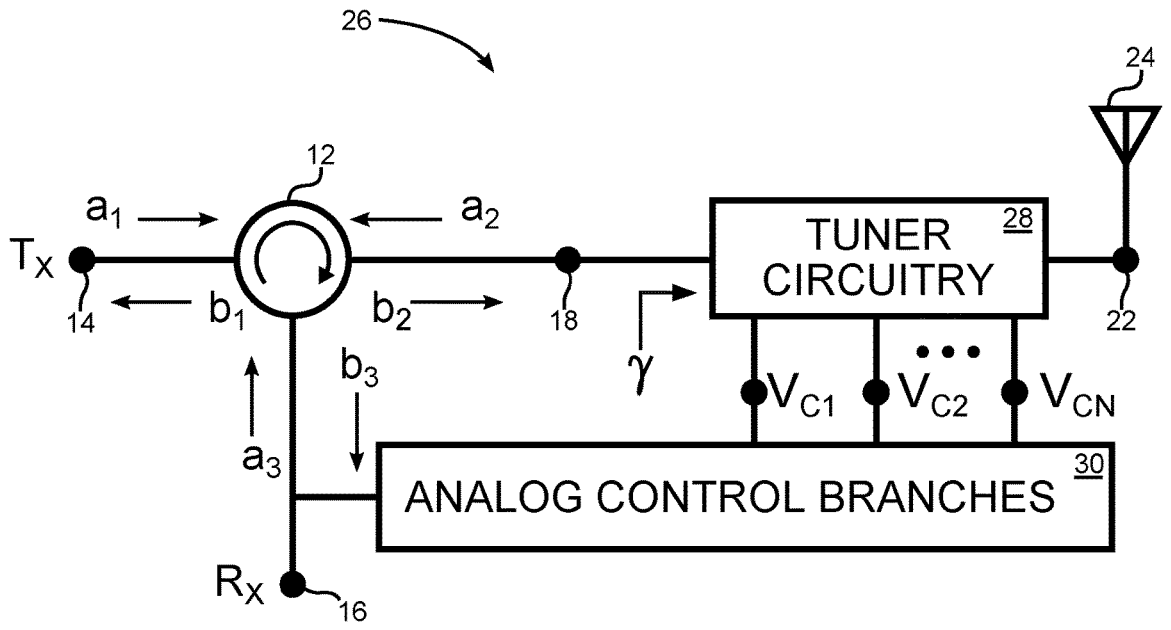
FIG. 6 depicts an enhanced circulator system that implements the present method by replacing or modifying the related-art antenna tuner of FIG. 1 with electronically controllable tuner circuitry of the present disclosure.

This disclosure provides circuit architectures that implement the present method for simultaneously cancelling transmit leakage power at the $R_X$ port 16 of the circulator 12 and correcting for non-unity antenna voltage standing wave ratio (VSWR). As illustrated in FIG. 6, which depicts an enhanced circulator system 26, the present method is implemented by replacing or modifying the antenna tuner 20 of FIG. 1 to become electronically controllable tuner circuitry 28. The tuner circuitry 28 is coupled between the tuner port 18 and the antenna port 22 and is automatically electronically tuned such that a cancellation signal is generated from a small amount of transmit power reflected back into the circulator through the tuner port 18 and thereby directed toward the $R_X$ port 16. The tuner circuitry 28 is also automatically electronically tuned such that the cancellation signal is of equal amplitude and opposite phase of that of the $T_X$ leakage signal that leaks from the $T_X$ port 14 to the $R_X$ port 16 such that the reflected signal and the $T_X$ leakage signal cancel. Various control loop architectures are proposed herein that detect the transmit leakage signal at the $R_X$ port and automatically adjust the tuner circuitry 28 to achieve a predetermined target level of cancellation of the transmit leakage signal.

As further shown in FIG. 6, the impedance of the tuner circuitry 28 is controlled through an N number of control signal inputs for bias voltages $V_{C1}$ to $V_{CN}$, wherein N is a natural number. One or more analog control branches 30 coupled between the $R_X$ port 16 and the control signal inputs $V_{C1}$ to $V_{CN}$ provide one or more control signals that automatically electronically tune the tuner circuitry 28 to cancel or at least attenuate the $T_X$ leakage signal that leaks from the $T_X$ port 14 to the $R_X$ port 16. In addition, the tuner circuitry 28 also maintains the role of antenna tuner 20 (FIG. 1) to automatically correct non-unity VSWR as antenna impedance fluctuates due to environmental settings.

Figure 7:
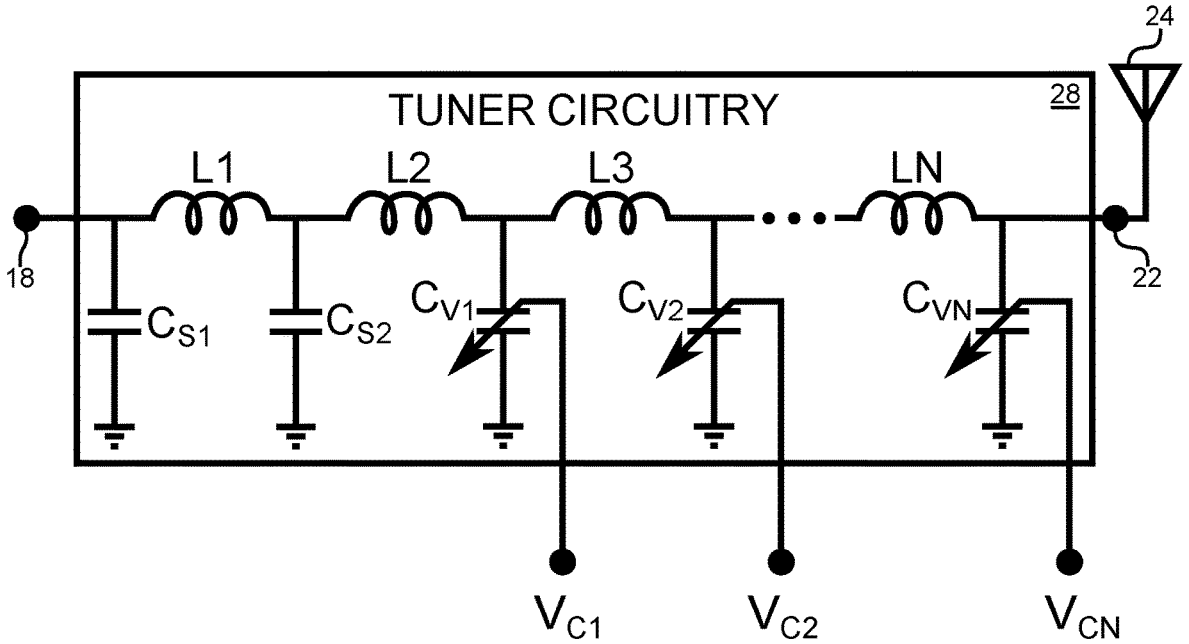
FIG. 7 is a schematic of an exemplary tuner circuitry configured in accordance with the present disclosure.

FIG. 7 is a schematic of an exemplary embodiment of the tuner circuitry 28 that is an inductor—capacitor (LC) ladder network, which includes a series string of inductors L1, L2, and L3 through LN coupled between the antenna port 22 and the tuner port 18. The inductors L1, L2, and L3 through LN have inductances on the order of nanohenries with quality factors (Qs) around 80. Further included are a first shunt capacitor $C_{S1}$ and a second shunt capacitor $C_{S2}$, both of which in this exemplary embodiment have fixed capacitances on the order of picofarads. Further included are a first voltage variable capacitor (varactor) $C_{V1}$, or first varactor $C_{V1}$, and a second varactor $C_{V2}$ through an Nth varactor $C_{VN}$.

Figure 8:
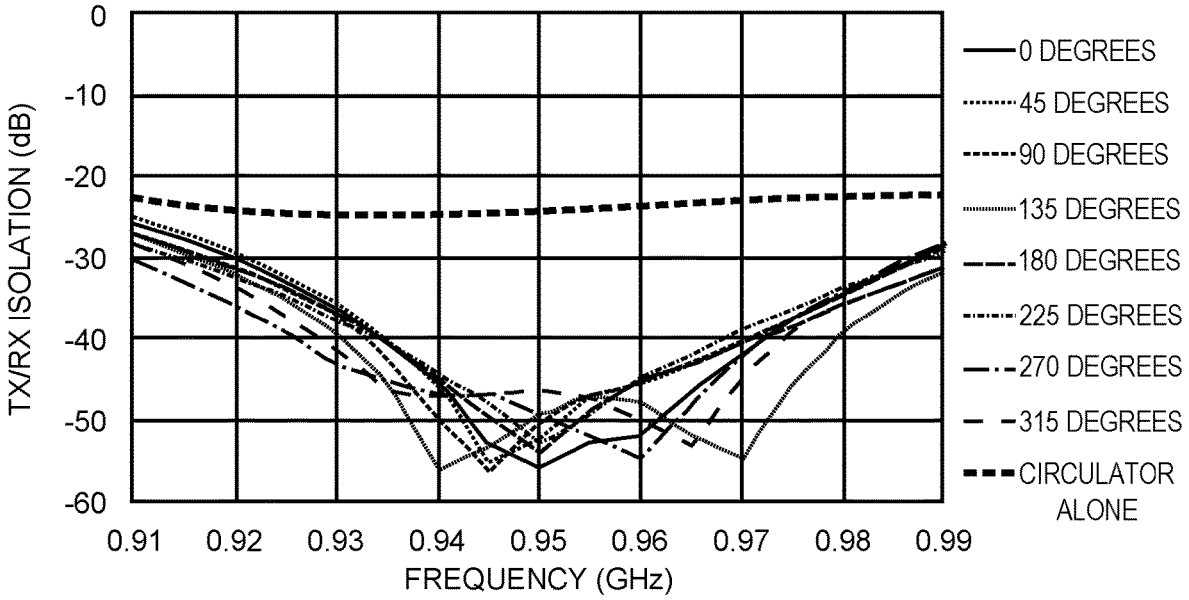
FIG. 8 is a graph of $T_X$ leakage cancellation versus angle.
Figure 9:
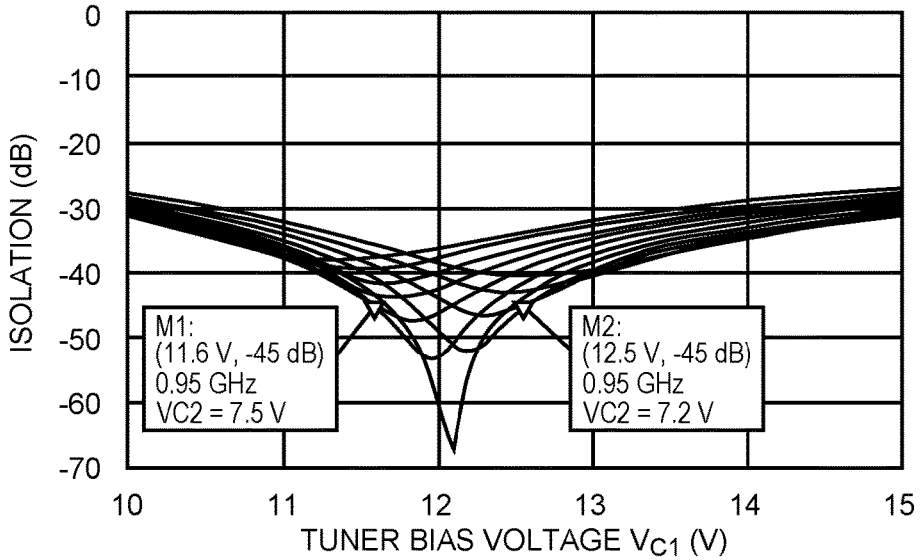
FIG. 9 is a graph of circulator isolation versus tuner bias voltage.

In the exemplary embodiment of FIG. 7, the first varactor $C_{V1}$ and the second varactor $C_{V2}$ through the Nth varactor $C_{VN}$ are realized as commercially available barium strontium titanate (BST) voltage variable capacitors. BST varactors exhibit a 5:1 tuning range, low loss with Qs at around 70, 10 W power handling, and high linearity. Simulated results using the measured circulator data and the exemplary tuner circuitry 28 shown in FIG. 7 are plotted in FIG. 8 for a 1.5:1 antenna VSWR pulled over angle. The exemplary tuner circuitry 28 achieves more than 20 dB of $T_X$ leakage cancellation for a 1.5:1 VSWR antenna pulled over angle. Very high sensitivity to tuner bias voltage was observed, as illustrated in FIG. 9. This family of $T_X$ leakage curves is for a 1.5:1 VSWR antenna at an angle of 315°. For 45 dB of $T_X$ leakage rejection, the exemplary tuner circuitry 28 is tuned by setting the bias voltage $V_{C1}$ to between 11.59 V and 12.55 V, while the bias voltage $V_{C2}$ remains between 7.2 V and 7.5 V. These ranges of bias voltages for control signal inputs $V_{C1}$ and $V_{C2}$ fall within a solution space for the exemplary tuner circuitry 28. For bias voltages outside of these ranges the enhanced circulator system 26 (FIG. 6) implemented with the exemplary tuner circuitry 28 (FIG. 7) cannot achieve 45 dB of $T_X$ leakage rejection. Note that the solution space reduces as the amount of rejection increases. Any change to the environment in which the enhanced circulator system 26 operates, such as temperature and antenna impedance, shifts the bias voltage solution space to a different predetermined range.

The sensitivity to tuner bias voltage, or alternatively tuner capacitance, is a consequence of cancelling signals to 45 dB or below. An acceptable level of tuning an antenna such as antenna 24 might be 20-25 dB, which can be accomplished with digitally controlled switched capacitor banks. Such components are readily available and widely used in mobile devices. However, the smallest capacitance step available in these components is far too large to consistently achieve the precise capacitance settings required for cancellation of $T_X$ leakage signal to a 45 dB or higher level. Furthermore, for embodiments of this disclosure to be practical, analog detection and control of the tuner bias voltages will likely be required. Continuously variable analog varactors, such as BST varactors, are more practical for demanding applications. However, it is to be understood that other components, such as electrically tunable radio frequency inductors with analog control in other impedance matching network topologies, may be substituted for variable analog varactors without deviating from the scope of the present disclosure.

Figure 10:
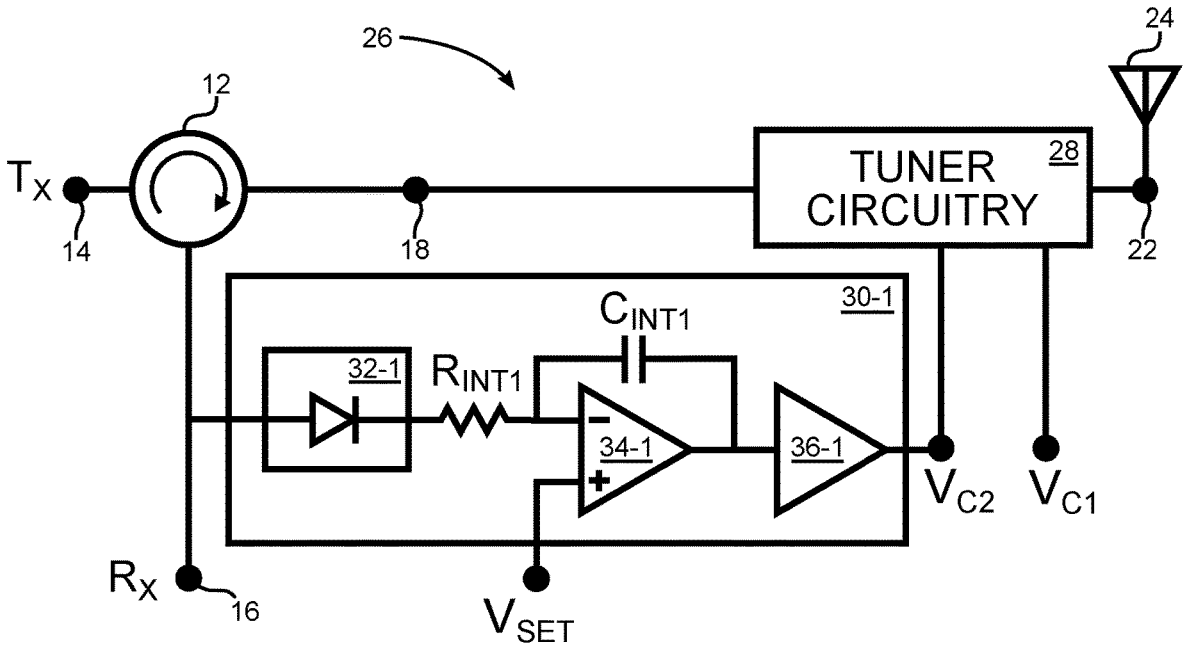
FIG. 10 is a detailed schematic of an exemplary embodiment of an enhanced circulator system having a single analog control loop.

A more detailed exemplary embodiment of the enhanced circulator system 26 is depicted in FIG. 10. A first analog control branch 30-1 includes a first log detector 32-1 and a first operational amplifier 34-1 that can be integrated together as a single device. The first log detector 32-1 is coupled to the $R_X$ port 16 to sample a small portion of the $T_X$ leakage signal entering the $R_X$ port 16. The first log detector 32-1 generates a direct current voltage proportional to the $T_X$ leakage signal in decibels. The first operational amplifier 34-1 is configured as an integrator by having a first integrating resistor $R_{INT1}$ coupled between a log output of the first log detector 32-1 and an inverting input of the first operational amplifier 34-1 with a first integrating capacitor $C_{INT1}$ coupled between the inverting input and an amplifier output of the first operational amplifier 34-1. This integration configuration of the first operational amplifier 34-1 prevents oscillations from developing at the amplifier output. A voltage set point $V_{SET}$ for the first analog control branch 30-1 is input to a non-inverting input of the first operational amplifier 34-1.

Typically, voltage levels output from the amplifier output of the first operational amplifier 34-1 are too low to drive a typical 1-24 V bias range of the BST varactors, which in the embodiment of the tuner circuitry 28 are first varactor $C_{V1}$ and the second varactor $C_{V2}$ through the Nth varactor $C_{VN}$. As such, a first BST driver 36-1 depicted in the exemplary embodiment of FIG. 10 is coupled between the tuner bias port for the bias voltage $V_{C2}$ and the amplifier output of the first operational amplifier 34-1. The first log detector 32-1, the first operational amplifier 34-1, and the first BST driver 36-1 included in the first analog control branch 30-1 combine with the tuner circuitry 28 and the circulator 12 to form a feedback loop to cancel the $T_X$ leakage voltage entering the $R_X$ port 16.

Figure 12:
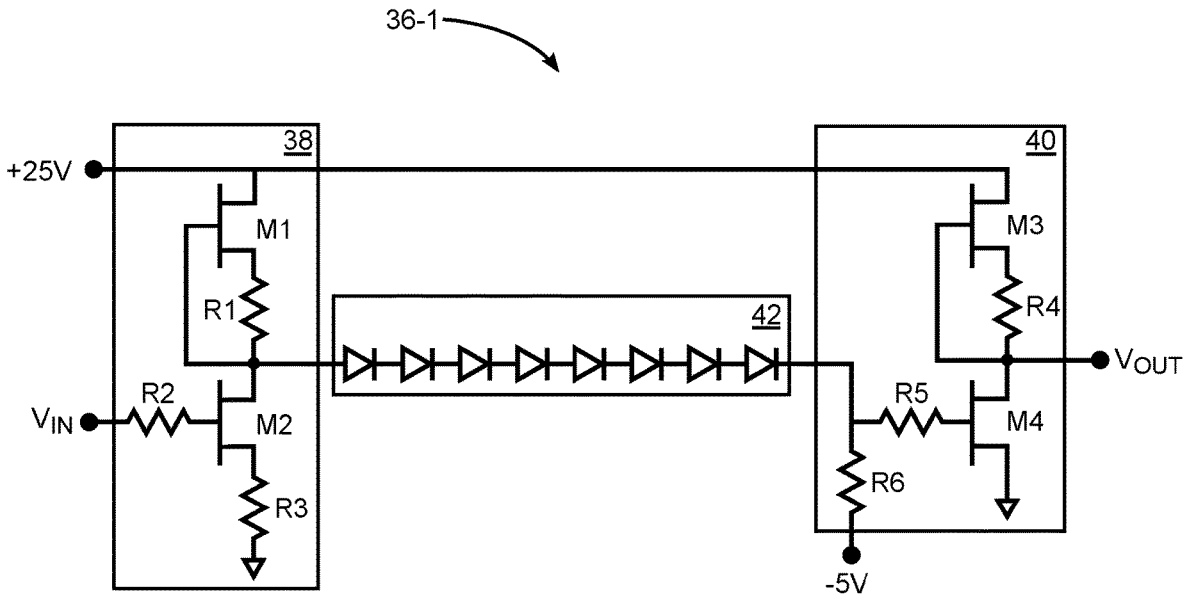
FIG. 12 is a schematic of an exemplary schematic of a barium strontium titanate (BST) driver.

FIG. 12 depicts an exemplary detailed embodiment of the first BST driver 36-1, which is a level shifting circuit that converts the low-voltage output range of the first operational amplifier 34-1 to the typical 1-24 V bias range of the BST varactors. The exemplary BST driver 36-1 is realized with high voltage field-effect transistor technology. As depicted in FIG. 12, the first BST driver 36-1 includes an input stage 38 having an input port $V_{IN}$ that couples to the amplifier output of the first operational amplifier 34-1 and an output stage 40 having an output port $V_{OUT}$ that couples to the tuner bias port that receives the bias voltage $V_{C2}$.

The input stage 38 is coupled to the output stage 40 through a diode string 42. The input stage is made up of a first transistor M1 having a drain coupled to a high voltage node that in this exemplary case is fixed at 25 V. A gate of the first transistor M1 is coupled to a drain of a second transistor M2 with a source of the first transistor M1 being coupled to the drain of the second transistor M2 through a first resistor R1. A second resistor R2 is coupled between the input port $V_{IN}$ that couples to the output port of the operational amplifier 34-1 (FIG. 10) and the gate of the second transistor M2. A third resistor R3 is coupled between a source of the second transistor M2 and a fixed voltage node such as ground. In the exemplary embodiment of FIG. 12, the diode string 42 is made up of eight diodes coupled in series anode to cathode with the anode of the first diode being connected directly to the drain of the second transistor M2.

Figure 13:
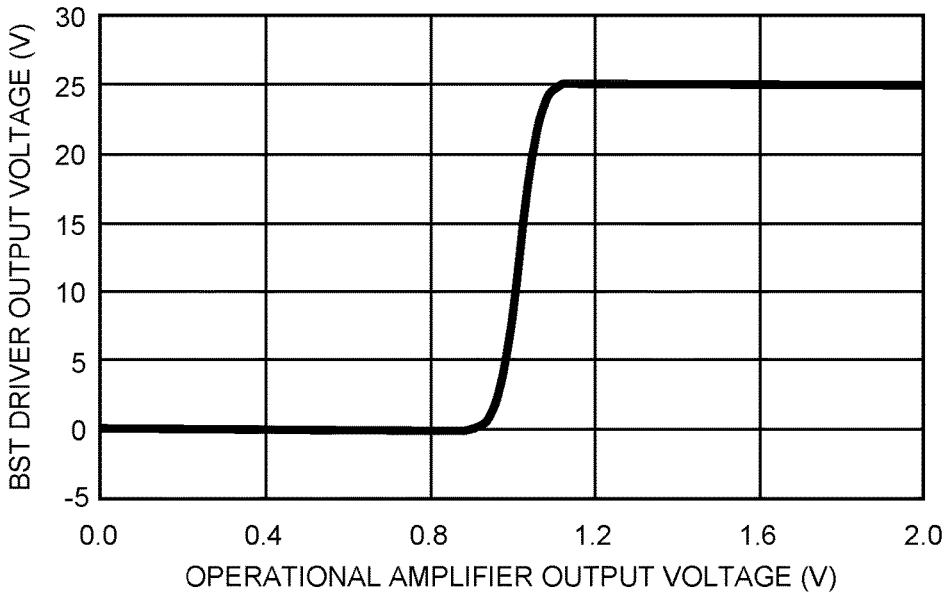
FIG. 13 is a transfer characteristic graph for the BST driver of FIG. 12.

The output stage 40 includes a third transistor M3 having a drain coupled to the high voltage node that is fixed at 25 V. A gate of the third transistor M3 is coupled to a drain of a fourth transistor M4 with a source of the third transistor M3 being coupled to the drain of the fourth transistor M4 through a fourth resistor R4. The drain of the fourth transistor M4 functions as the output port $V_{OUT}$ that is coupled to the tuner bias port that receives the bias voltage $V_{C2}$. A source of the fourth transistor M4 is coupled to a fixed voltage node such as ground. A fifth resistor R5 is coupled between a cathode of the last diode of the diode string 42 and the gate of the fourth transistor M4. The cathode of the last diode of the diode string 42 is also coupled to a negative voltage node through a sixth resistor R6. In the exemplary embodiment of FIG. 12, the negative voltage node is fixed at −5 V. A simulated transfer characteristic of the first BST driver 36-1 is shown in FIG. 13. Notice that the transfer characteristic has a steep slope at around 1 V of output voltage of the operational amplifier 34-1 applied to the input port $V_{IN}$ of the first BST driver 36-1. Notice also that the BST driver output port $V_{OUT}$ swings from 0 V to 25 V. Thus, the BST driver 36-1 is configured to output voltages spanning a full capacitance control range of the BST varactor.

Figure 11:
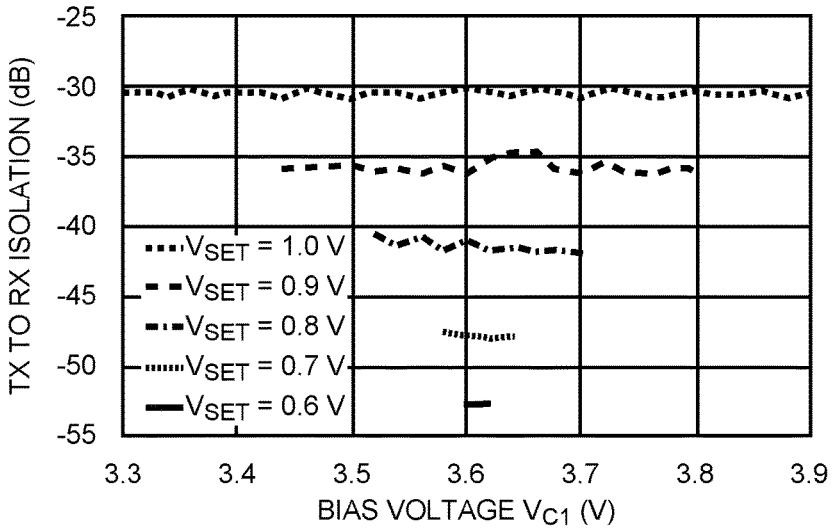
FIG. 11 is a graph of simulation data for $T_X$ to $R_X$ isolation versus bias voltage for the embodiment of FIG. 10.

Returning to FIG. 10, the first operational amplifier 34-1 and first BST driver 36-1 drive the tuner circuitry 28 in a feedback loop such that the output of the first log detector 32-1 is approximately equal to the externally applied voltage set point $V_{SET}$. The resistor-capacitor (RC) product of the first integrating resistor $R_{INT1}$ and the first integrating capacitor $C_{INT1}$ of the first operational amplifier 34-1 are configured to avoid ringing and potential oscillation. A lower voltage set point $V_{SET}$ voltage results in a lower output voltage from the first log detector 32-1 and more $T_X$ leakage cancellation. However, this only occurs if the applied tuner bias voltage $V_{C1}$ is within the solution space of the tuner circuitry 28. This is illustrated in the simulation of this system plotted in FIG. 11. As depicted in FIG. 11, as voltage set point $V_{SET}$ decreases, the $T_X$ leakage cancellation increases and the range of valid bias voltages $V_{C1}$ decreases.

Operation of the enhanced circulator system 26 shown in FIG. 10 may proceed as follows. With $T_X$ power applied and voltage set point $V_{SET}$ set to produce a desired level of $T_X$ leakage rejection, bias voltage $V_{C1}$ may be decreased from 24 V while sampling $T_X$ leakage at the $R_X$ port 16, which will likely be at a high level. Once the tuner bias voltage $V_{C1}$ enters the solution space for the voltage set point $V_{SET}$ level, the first operational amplifier 34-1 locks its inverting input to the voltage set point $V_{SET}$ as the $T_X$ leakage at the $R_X$ port 16 decreases to the desired level. Once this occurs, bias voltage $V_{C1}$ may stop decreasing and remain a fixed value at its present value. However, bias voltage $V_{C1}$ and voltage set point $V_{SET}$ typically need to be readjusted if the operational environment or $T_X$ power level changes.

Figure 14:
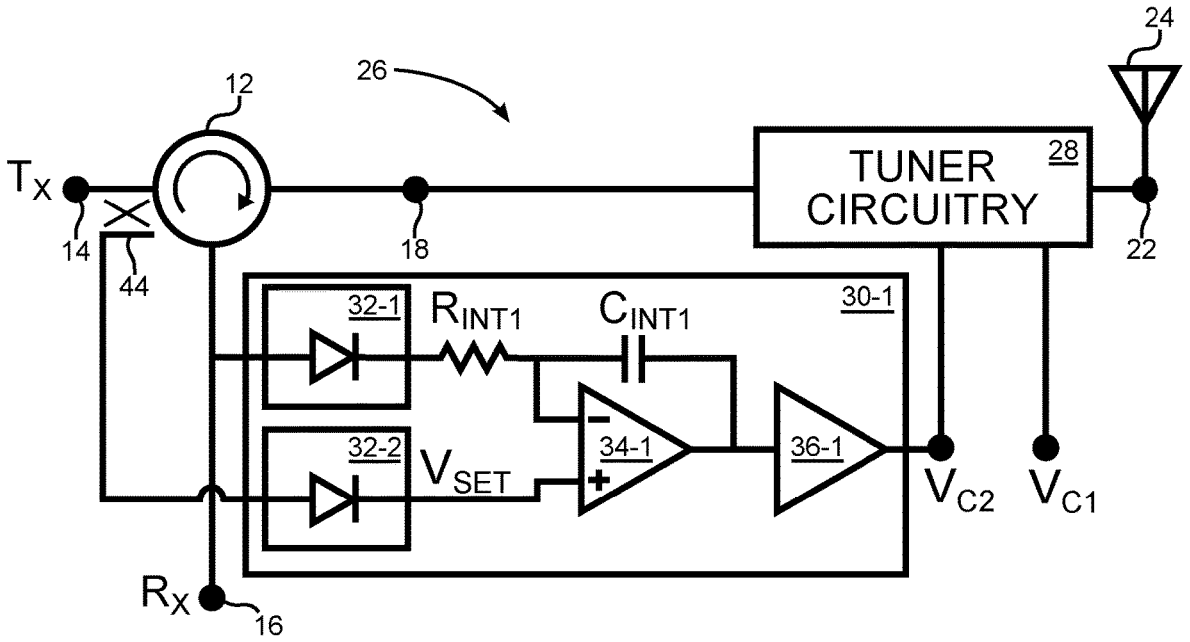
FIG. 14 is a schematic of a modified version of the enhanced circulator system with automatic $V_{SET}$ generation.
Figure 15:
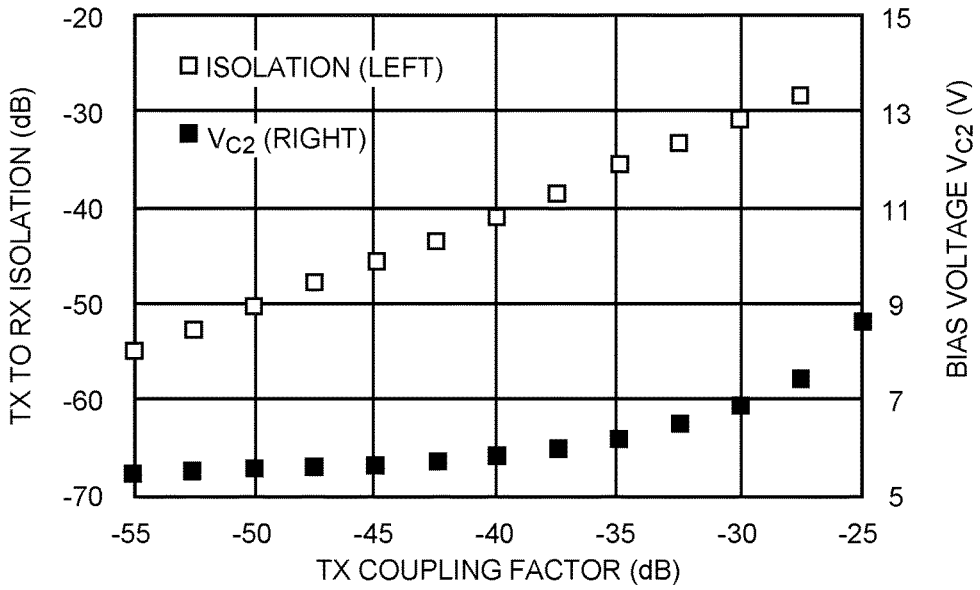
FIG. 15 is a graph of $T_X$ to $R_X$ isolation versus $T_X$ coupling for the embodiment of FIG. 14.

A modified version of the enhanced circulator system 26 is depicted schematically in FIG. 14. In this embodiment, an RF coupler 44 is coupled to the $T_X$ port 14 to sample the $T_X$ power applied to the $T_X$ port 14. A second log detector 32-2 is coupled between the RF coupler 44 and the non-inverting input of the first operational amplifier 34-1 to automatically generate the set voltage $V_{SET}$ for a fixed level of $T_X$ power and $T_X$ leakage rejection. A coupling factor for the RF coupler 44 sets a fixed level of rejection in decibels that is independent of the $T_X$ power level. A simulation of the $T_X$ leakage and tuner bias voltage $V_{C2}$ versus coupling factor corresponding to a $T_X$ leakage rejection goal is plotted in FIG. 15. In FIG. 15, the $T_X$ power applied to the $T_X$ port 14 is swept from 25 dBm to 40 dBm in 5 dBm steps. As illustrated, a target $T_X$ leakage rejection level is well approximated over the $T_X$ power range. The first tuner bias voltage $V_{C1}$ is fixed and the second tuner bias voltage $V_{C2}$ only varies from 5.4 V to 8.5 V to achieve a 25 dB change in $T_X$ leakage rejection. The tuner control loop of this architecture is also temperature compensated provided the first log detector 32-1 and the second log detector 32-2 have an equal temperature variation. However, the modified version of the enhanced circulator system 26 shown in FIG. 14 requires adjustment of the tuner bias voltage $V_{C1}$ and is not temperature compensated with respect to variation in the tuner circuitry 28.

Figure 16:
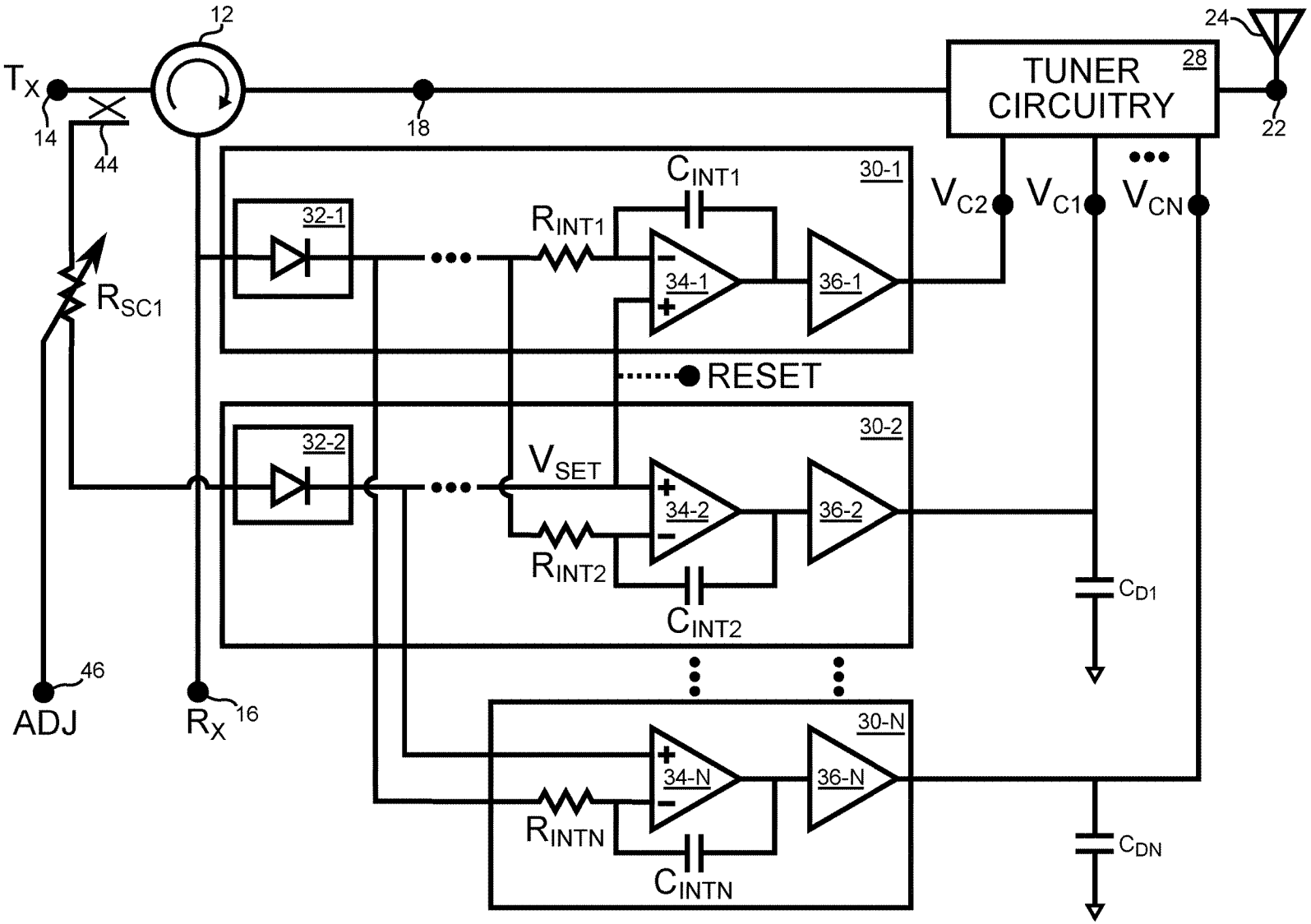
FIG. 16 is a schematic of a modified version of the enhanced circulator system having a plurality of analog control branches to implement a plurality of control loops for greater $T_X$ leakage signal cancellation.

Yet another modified version of the enhanced circulator system 26 is depicted in FIG. 16. This architecture employs a plurality of feedback loops to control tuner bias voltages $V_{C1}$ and $V_{C2}$ through $V_{CN}$. The feedback loops include components of analog control branches 30-1 and 30-2 through 30-N. Operational amplifiers 34-2 through 34-N are identical to the first operational amplifier 34-1. Moreover, in at least some embodiments, additional integrating resistors $R_{INT2}$ through $R_{INTN}$ and integrating capacitors $C_{INT2}$ through $C_{INTN}$ are identical in characteristics to the first integrating resistor $R_{INT1}$ and the first integrating capacitor $C_{INT1}$, respectively. Moreover, a second BST driver 36-2 through an Nth BST driver 36-N have the identical structure of the first BST driver 36-1 depicted in FIG. 12.

The operating principle of this embodiment is as follows. A reset voltage is applied to the non-inverting inputs of the operational amplifiers 34-1 through 34-N. Provided the reset voltage is higher than a maximum detected output voltage level of an initial output voltage of each of the operational amplifiers 34-1 through 34-N, the output voltage of each of the operational amplifiers 34-1 through 34-N transitions to a maximum voltage level. In response, each of the BST drivers 36-1 through 36-N follows by transitioning to a maximum voltage, which in the exemplary case is 25 V. Therefore, tuner bias voltages $V_{C1}$ through $V_{CN}$ are pinned to 25 V, and capacitors $C_{D1}$ through $C_{DN}$ coupled between corresponding BST drivers 36-2 through 36-N and ground each charge to 25 V. The $T_X$ leakage is high in this reset state as the tuner circuitry 28 is not biased for $T_X$ leakage cancellation.

In this regard, next assume that the reset signal is disabled, leaving the first log detector 32-1 that is coupled to the $R_X$ port 16 near its maximum output voltage due to a relatively high $T_X$ leakage level. The output voltage of the second log detector 32-2 coupled to the $T_X$ port 14 drops to the value associated with the desired leakage level, which is less than that of the first log detector 32-1. This response forces operational amplifiers 34-1 through 34-N to transition to their minimum output level. Tuner bias voltage $V_{C2}$ transitions from 25 V to near 0 V. Tuner bias voltages $V_{C1}$ through $V_{CN}$ excluding $V_{C2}$ also decrease, but more slowly, as capacitors $C_{D1}$ through $C_{DN}$ discharge. The discharging of capacitors $C_{D1}$ through $C_{DN}$ mimics a manual ramping of the tuner bias voltages $V_{C1}$ through $V_{CN}$, excluding $V_{C2}$. When the tuner bias voltages $V_{C1}$ through $V_{CN}$ enter the solution space for the tuner circuitry 28, the operational amplifiers 34-1 through 34-N lock their inverting input voltages near the output voltage of the second log detector 32-2. The addition of the capacitors $C_{D1}$ through $C_{DN}$ may be avoided by using different RC products for the operational amplifiers 34-1 through 34-N. The enhanced circulator system 26 of FIG. 16 is fully temperature compensated as long as the analog control branches 30-1 through 30-N are within nominal operational temperature ranges.

The exemplary embodiment of FIG. 16 further includes an electronically adjustable attenuator $R_{SC1}$ for scaling the signal representing the transmit power sampled from the $T_X$ port 14. A control terminal 46 labeled ADJ in FIG. 16 may be coupled to a control output of a baseband processor (not shown) that is configured to automatically proportionally scale the signal representing the transmit power sampled from the $T_X$ port 14 whenever transmit power is increased or decreased.

Those skilled in the art will recognize improvements and modifications to the preferred embodiments of the present disclosure. All such improvements and modifications are considered within the scope of the concepts disclosed herein and the claims that follow.

What is claimed is:

1. An apparatus comprising:

a circulator having a transmit port, a receive port, and a tuner port;

tuner circuitry coupled between the tuner port and an antenna port; and at least one analog control branch coupled between the receive port and at least one control input of the tuner circuitry to generate at least one control signal from a transmit leakage signal leaking into the receive port, wherein the tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −30 dB between the transmit port and the receive port.

2. The apparatus of claim 1 wherein the at least one analog control branch includes a log detector with a detector output in communication with the at least one control input of the tuner circuitry, wherein the log detector is configured to detect the transmit leakage signal and output a direct current signal in proportion with the transmit leakage signal.

3. The apparatus of claim 2 wherein the at least one analog control branch further includes an operational amplifier with an amplifier input coupled to the detector output and an amplifier output in communication with the at least one control input of the tuner circuitry.

4. The apparatus of claim 3 wherein the operational amplifier is configured as an integrator.

5. The apparatus of claim 3 wherein the tuner circuitry includes at least one barium strontium titanate (BST) capacitor coupled to the at least one control input of the tuner circuitry and configured as a tunable component of the tuner circuitry.

6. The apparatus of claim 5 wherein the at least one analog control branch includes a BST driver with a driver input coupled to the amplifier output, wherein the BST driver is configured to output voltages spanning a full capacitance control range of the BST capacitor.

7. The apparatus of claim 1 wherein the tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −40 dB between the transmit port and the receive port.

8. The apparatus of claim 1 wherein the tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −45 dB between the transmit port and the receive port.

9. The apparatus of claim 1 wherein the tuner circuitry is configured to respond to the at least one control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −50 dB between the transmit port and the receive port.

10. An apparatus comprising:

a circulator having a transmit port, a receive port, and a tuner port;

tuner circuitry coupled between the tuner port and an antenna port; and an analog control branch comprising:

a first input coupled between the receive port and at least one control input of the tuner circuitry to generate a first portion of a control signal from a transmit leakage signal leaking into the receive port; and a second input coupled between the transmit port and the at least one control input of the tuner circuitry to generate a second portion of the control signal from a transmit signal at the transmit port, wherein the tuner circuitry is configured to respond to the control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −30 dB between the transmit port and the receive port.

11. The apparatus of claim 10 wherein the analog control branch comprises:

a first log detector with a first detector output in communication with the at least one control input of the tuner circuitry, wherein the first log detector is configured to detect the transmit leakage signal and output a first direct current signal in proportion with the transmit leakage signal;

an operational amplifier with a first amplifier input coupled to the first detector output and an amplifier output in communication with the at least one control input of the tuner circuitry; and a second log detector with a first detector output coupled to a second amplifier input of the operational amplifier, wherein the second log detector is configured to detect the transmit signal and output a second direct current signal in proportion with the transmit signal.

12. The apparatus of claim 11 wherein the operational amplifier is configured as an integrator.

13. The apparatus of claim 11 wherein the tuner circuitry includes at least one barium strontium titanate (BST) capacitor coupled to the at least one control input of the tuner circuitry and configured as a tunable component of the tuner circuitry.

14. The apparatus of claim 13 wherein the analog control branch includes a BST driver with a driver input coupled to the amplifier output, wherein the BST driver is configured to output voltages spanning a full capacitance control range of the at least one BST capacitor.

15. An apparatus comprising:

a circulator having a transmit port, a receive port, and a tuner port;

tuner circuitry coupled between the tuner port and an antenna port; and a first analog control branch coupled between the receive port and one of a plurality of control inputs of the tuner circuitry to generate a first control signal from a transmit leakage signal leaking into the receive port; and a second analog control branch coupled between the transmit port and another of the plurality of control inputs of the tuner circuitry to generate a second control signal from a transmit signal at the transmit port, wherein the tuner circuitry is configured to respond to the first control signal and the second control signal by automatically electronically tuning such that a cancellation signal of substantially equal amplitude and opposite phase of that of the transmit leakage signal is reflected through the tuner port and into the receive port, thereby reducing the transmit leakage signal to a level corresponding to an isolation of at least −30 dB between the transmit port and the receive port.

16. The apparatus of claim 15 wherein the first analog control branch includes a first log detector with a first detector output and the second analog control branch includes a second log detector with a second detector output, wherein the first log detector is configured to detect the transmit leakage signal and output a first direct current signal in proportion with the transmit leakage signal and the second log detector is configured to detect a transmit signal at the transmit port and output a second direct current signal in proportion with the transmit signal.

17. The apparatus of claim 16 further comprising a plurality of additional analog control branches coupled between the first detector output, the second detector output, and corresponding ones of the plurality of control inputs of the tuner circuitry.

18. The apparatus of claim 17 wherein the tuner circuitry includes a plurality of barium strontium titanate (BST) capacitors, one for each of the plurality of control inputs of the tuner circuitry with each of the plurality of BST capacitors being configured as a tunable component of the tuner circuitry.

19. The apparatus of claim 18 wherein each of the first analog control branch, the second analog control branch, and the plurality of additional analog control branches comprise an operational amplifier having an amplifier output with analog inputs coupled to the first detector output and a second analog input, respectively, and a BST driver with a driver input coupled to the amplifier output, wherein the BST driver is configured to output voltages spanning a full capacitance control range of a corresponding one of the plurality of BST capacitors.

20. The apparatus of claim 15 further including an electronically adjustable attenuator for scaling the signal representing transmit power sampled from the transmit port.

* * * * *